US007649510B2

(12) United States Patent
Baek

(10) Patent No.: US 7,649,510 B2
(45) Date of Patent: Jan. 19, 2010

(54) PLASMA DISPLAY APPARATUS AND IMAGE PROCESSING METHOD THEREOF

(75) Inventor: Seung Chan Baek, Seoul (KR)

(73) Assignee: LG Electronics Inc., Seoul (KR)

( * ) Notice: Subject to any disclaimer, the term of this patent is extended or adjusted under 35 U.S.C. 154(b) by 670 days.

(21) Appl. No.: 11/176,236

(22) Filed: Jul. 8, 2005

(65) Prior Publication Data

US 2006/0007067 A1 Jan. 12, 2006

(30) Foreign Application Priority Data

Jul. 9, 2004 (KR) ..... 10-2004-0053488

(51) Int. Cl.
*G09G 3/28* (2006.01)

(52) U.S. Cl. ..... 345/63; 345/596

(58) Field of Classification Search ..... 345/60, 345/63, 212, 690–695, 68, 596; 315/169.4; 358/3.06; 382/252
See application file for complete search history.

(56) References Cited

U.S. PATENT DOCUMENTS

| | | | | |
|---|---|---|---|---|
| 6,069,609 | A | 5/2000 | Ishida et al. | |
| 6,552,736 | B2 * | 4/2003 | Honda et al. | 345/691 |
| 6,606,168 | B1 * | 8/2003 | Rylander | 358/3.09 |
| 6,614,413 | B2 * | 9/2003 | Tokunaga et al. | 345/63 |
| 6,768,477 | B2 * | 7/2004 | Beuker et al. | 345/55 |
| 2003/0006994 | A1 | 1/2003 | Suzuki | |

FOREIGN PATENT DOCUMENTS

| | | | |
|---|---|---|---|
| EP | 0622950 | A2 | 11/1994 |
| EP | 1083539 | A2 | 3/2001 |
| JP | 2000-227778 | | 8/2000 |
| JP | 2000-276100 | | 10/2000 |
| JP | 2001-154630 | | 6/2001 |
| JP | 2003-195801 | | 7/2003 |
| WO | WO 00/43979 | | 7/2000 |

* cited by examiner

*Primary Examiner*—Abbas I Abdulselam
(74) *Attorney, Agent, or Firm*—McKenna Long & Aldridge LLP

(57) ABSTRACT

The present invention relates to a plasma display apparatus and an image processing method thereof, and more particularly, the present invention relates to an improved plasma display apparatus and an image processing method thereof which can enhance a gray level representation capability.

The plasma display apparatus according to one embodiment of the present invention comprises a plasma display panel including a plurality of address electrodes; an inverse gamma correction section for inverse gamma-correcting an image signal inputted from an exterior; a halftone section in which a subordinate bit of a fraction bit of the image signal which is inverse gamma-corrected divides a plurality of pixels adjacent to each other into at least two or more types, an error diffusion is performed among the pixels corresponding to any one type, and a superior bit of the fraction bit performs a dithering using at least two or more dither mask patterns; and a subfield mapping section for mapping the image signal which is halftone processed on the corresponding subfield.

The present invention is advantageous in that the flicker phenomenon is suppressed when the plasma display apparatus is operated and a distortion of the embodied image can be prevented.

30 Claims, 6 Drawing Sheets

Fig. 7
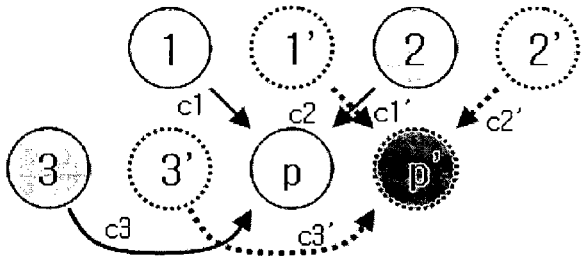
Fig. 8
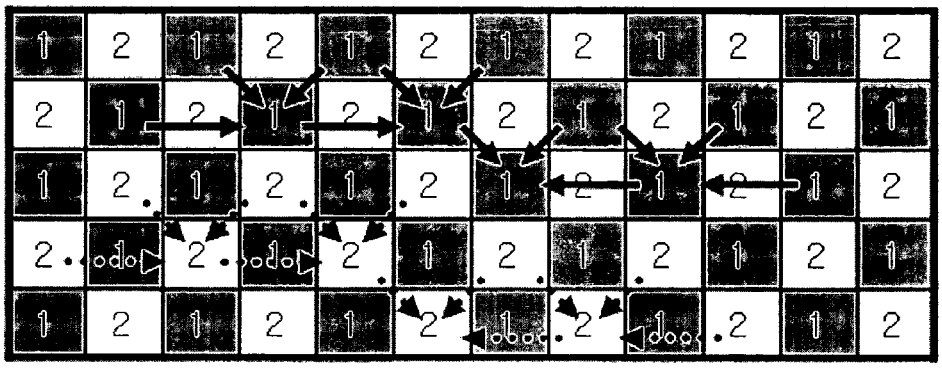
Fig. 9
Lookup Table of Type A
| coordinate / gray level value | c1 | c2 | c3 |
|---|---|---|---|
| 0 | XXX | XXX | XXX |
| ⋮ | | | |
| 15 | XXX | XXX | XXX |
Lookup Table of Type b
| coordinate / gray level value | c1' | c2' | c3' |
|---|---|---|---|
| 0 | XXX | XXX | XXX |
| ⋮ | | | |
| 15 | XXX | XXX | XXX |

PLASMA DISPLAY APPARATUS AND IMAGE PROCESSING METHOD THEREOF

This Nonprovisional application claims priority under 35 U.S.C. § 119(a) on Patent Application No. 10-2004-0053488 filed in Korea on Jul. 9, 2004, the entire contents of which are hereby incorporated by reference.

BACKGROUND OF THE INVENTION

1. Field of the Invention

The present invention relates to a plasma display apparatus and an image processing method thereof, and more particularly, the present invention relates to an improved plasma display apparatus and an image processing method thereof which can enhance a gray level representation capability.

2. Description of the Background Art

In general, in the plasma display apparatus, a wall formed between a front substrate and a rear substrate constitutes one unit cell, each cell is filled with a main discharge gas such as neon (Ne) or helium (He) and a mixture gas (Ne+He) and an inert gas containing a small quantity of xenon. When the discharge gas is discharged by the high-frequency voltage, the inert gas generates vacuum ultraviolet ray and the fluorescent substance existed between the walls emits light, and so the image is embodied. The plasma display apparatus as described above has been in the limelight as the next generation display apparatus since it is possible to make the plasma display apparatus having a thin and light structure.

FIG. 1 is a view illustrating a method for embodying the image in the conventional plasma display apparatus.

In the plasma display apparatus, as shown in FIG. 1, one frame period is divided into a plurality of subfields (the frequency of discharge in each subfield differs from those in the others), the plasma display panel emits the light in the subfield period corresponding to a gray level value of an image signal to be input, and so the image is embodied.

Each subfield is divided into a reset period for exciting uniformly the discharge, an address period for selecting the discharge cell and a sustain period for embodying the gray level according to the frequency of discharge. For example, in the case that the image with 256 gray levels is displayed, the frame period (16.67 ms) corresponding to 1/60 second is divided into eight subfields.

In addition, each of eight subfields is divided into the reset period, the address period and the sustain period again. Here, the sustain period is increased in each subfield at the rate of $2^n$ (n=0, 1, 2, 3, 4, 5, 6, 7). Since the sustain periods in the subfields differ from each other as described above, the gray level of the image can be embodied.

FIG. 2 is a graph for comparing the luminance characteristic of the plasma display apparatus with the luminance characteristic of the cathode ray tube.

In the cathode ray tube and the liquid crystal display device, the light to be displayed according to the input video signal is controlled in an the analog manner to represent the desired gray level, and so the cathode ray tube and the liquid crystal display device generally indicate a non-linear luminance characteristic. In the plasma display apparatus, contrary to the cathode ray tube and the liquid crystal display device, the number of the light pulse is modulated by using a matrix array of the discharge cells which can be turned on/off to represent the gray level, and so and the plasma display indicates a linear luminance characteristic. Such method for representing the gray level of the plasma display apparatus is called as the PWM (pulse width modulation) method.

At this time, since the brightness characteristic vs the display current is in proportion to a 2.2 multiplier, the display apparatus such as the cathode ray tube sends the signal corresponding to a reciprocal of 2.2 multiplier of an external input image signal such as the broadcasting signal. Accordingly, there is a need to inverse gamma correct the external input image signal in the plasma display apparatus indicating a linear brightness characteristic.

FIG. 3 is a graph showing an inverse gamma correction in the conventional plasma display apparatus.

In FIG. 3, the target luminance indicates the ideal result to be obtained by the inverse gamma correction, the real luminance indicates a measured luminance value represented as a result of the inverse gamma correction and the PDP luminance indicates the luminance value of 3 or less which is measured in the state that the inverse gamma correction is not performed.

As shown In FIG. 3, the target luminance is represented as one of the luminance values, each of which has the gray level of 61 steps (0 through 60). On the contrary, the real luminance is represented as eight luminance values, each of which has one of the gray levels of 61 steps (0 through 60). Accordingly, when the inverse gamma correction process is performed in the plasma display apparatus, a sufficient gray level representation can not be obtained in a dark area, and so there is a problem that the contour noise in which the images are lumped together is appeared.

In order to enhance the insufficient gray level representation capability of the plasma display apparatus, a half tone method such as a dithering method and an error diffusion method and the like has been used.

First of all, in the error diffusion method, fraction generated when the gray level value of the corresponding pixel is quantized, that is, an error has influence on the adjacent pixels so that the correction to an error to be discarded is spatially solved. An error diffusion coefficient to the adjacent pixel is set constantly, and so such error diffusion method is repeated to each line and each frame. Accordingly, there is a problem that the same error diffusion pattern is formed on the entire screen due to the constant error diffusion coefficient.

Next, the dithering method is the method for judging whether a carry is generated or not by comparing the gray level value of each pixel with a specific threshold of a dither mask. That is, the dithering method is the method for enhancing the insufficient gray level capability by turning on the pixel in which the carry is generated and turning off the pixel in which the carry is not generated. Such dithering mask uses a plurality of dither masks on which constant patterns are formed. Accordingly, there is a problem that the patterns of the dither mask are displayed on a screen due to repeated use of the dither mask.

In order to overcome the above problem of the error diffusion method and the dithering method and enhance the gray level capability, the error diffusion method is used together with the dithering method as shown in FIG. 4.

FIG. 4 is a view for illustrating the conventional method for using the error diffusion technique together with the dithering technique.

In the method in which the error diffusion and the dithering are used together, as shown in FIG. 4, a gray level data of the image signal which is already inverse gamma corrected is divided into an integer bit and a fraction bit first and the fraction bit is divided again into a superior bit and a subordinate bit. Then, the error diffusion is performed to the subordinate bit, if the carry is generated, the carry is reflected in the superior bit. Also, the dithering is performed to the superior bit, if the carry is generated, the carry is reflected in the integer bit. At this time, the integer bit is called as the real gray level, the image of the plasma display apparatus is embodied finally by using the real gray level value, and so it is possible to represent the various gray levels.

On the other hand, the method in which the error diffusion and the dithering are used together has a problem that a flicker is generated on the embodied image as shown in FIG. 5.

FIG. 5 is a view illustrating the problem occurred when the conventional method in which the error diffusion and the dithering are used together is applied.

As shown in FIG. 5, since the error diffusion is performed to entire pixels of each frame by means of the adjacent pixel placed at a constant position and a constant error diffusion coefficient, when the dithering to each frame is performed with different dither mask pattern, the patterns are matched with each other, and so the various problems are occurred.

As shown in FIG. 5, for example, pixels of the error diffusion pattern in which carry is generated are matched with pixels of the A typed dithering mask pattern in which carry is generated, and so desired image is embodied, while the pixels of the error diffusion pattern in which carry is generated are not matched with pixels of the B typed dithering mask pattern in which carry is generated, and so desired image is not embodied at all. As described above, if the error diffusion pattern is not matched with the dithering mask pattern, luminance differences of the screen on which the image is displayed are generated up to 50%. Due to such luminance differences, the flicker phenomenon in which the screen is flickered is occurred. Here, dark marks in the error diffusion pattern and dithering mask pattern indicate locations of the pixels in which carry is generated, dark marks in the screen on which the image is displayed indicate locations of the pixels which are turned on/off depending on whether carry is generated or not.

Also, due to the problems as described above, each gray level of R (red), G (green) and B (blue) of the origin image signal is distorted, and so the color of the image to be embodied is changed.

SUMMARY OF THE INVENTION

Accordingly, an object of the present invention is to solve at least the problems and disadvantages of the background art.

An object of the present invention is to provide the plasma display apparatus and the image processing method thereof which can enhance the gray lever representation capability by improving a halftone section and a method thereof.

Another object of the present invention is to provide the plasma display apparatus and the image processing method thereof which can prevent a flicker phenomenon from occurring in the case that the error diffusion method is applied together with the dithering method.

A further another object of the present invention is to provide the plasma display apparatus and the image processing method thereof which can prevent the image to be embodied from distorting.

The plasma display apparatus according to one embodiment of the present invention comprises a plasma display panel including a plurality of address electrodes; an inverse gamma correction section for inverse gamma-correcting an image signal inputted from an exterior; a halftone section for dividing a plurality of pixels adjacent to each other which a subordinate bit of a fraction bit of the image signal is allocated to into at least two or more types, performing an error diffusion among the subordinate bit of the fraction bit of the pixels corresponding to the same type, and performing a dithering of a superior bit of the fraction bit using at least two or more dither mask patterns; and a subfield mapping section for mapping the image signal which is halftone processed on the corresponding subfield.

The method for processing an image in a plasma display apparatus according to one embodiment of the present invention comprises the steps of (a) inverse gamma-correcting an image signal inputted from an exterior; (b) dividing a plurality of pixels adjacent to each other which a subordinate bit of a fraction bit of the image signal is allocated to into at least two or more types, performing an error diffusion among the subordinate bit of the fraction bit of the pixels corresponding to the same type, and performing a dithering of a superior bit of the fraction bit using at least two or more dither mask patterns; and (c) mapping the image signal which is halftone processed on the corresponding subfield.

The plasma display apparatus of the present invention is advantageous in that the gray lever representation capability can be enhanced by improving the halftone section and the method thereof.

Also, the present invention is advantageous in that it is possible to prevent a flicker phenomenon from occurring in the case that the error diffusion method is applied together with the dithering method.

In addition, the present invention can prevent the image to be embodied from distorting.

BRIEF DESCRIPTION OF THE DRAWINGS

The invention will be described in detail with reference to the following drawings in which like numerals refer to like elements.

FIG. 7 is a view for illustrating the error diffusion method according to one embodiment of the present invention;

FIG. 8 is a view showing schematically that the error diffusion is performed on the entire screen by the error diffusion method according to one embodiment of the present invention;

FIG. 9 is a view showing schematically a lookup table in which the error diffusion coefficient according to one embodiment of the present is stored.

DETAILED DESCRIPTION OF PREFERRED EMBODIMENTS

Figure 1:
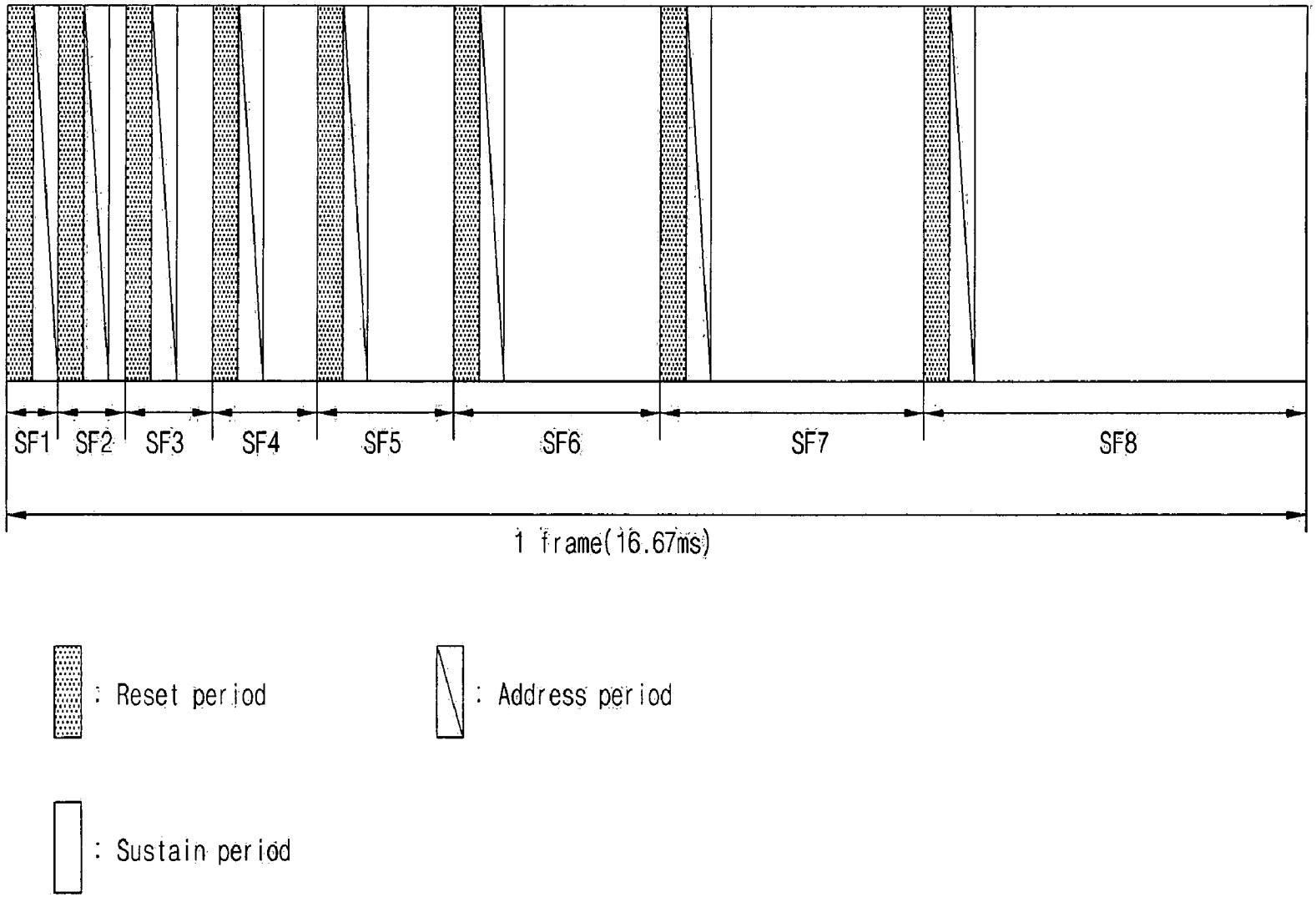
FIG. 1 is a view illustrating a method for embodying the image in the conventional plasma display apparatus.
Figure 2:
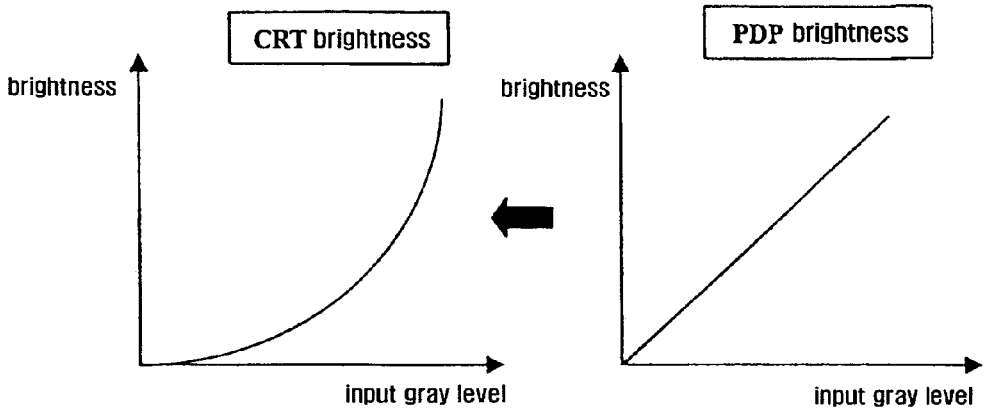
FIG. 2 is a graph for comparing the luminance characteristic of the plasma display apparatus with the luminance characteristic of the cathode ray tube.
Figure 3:
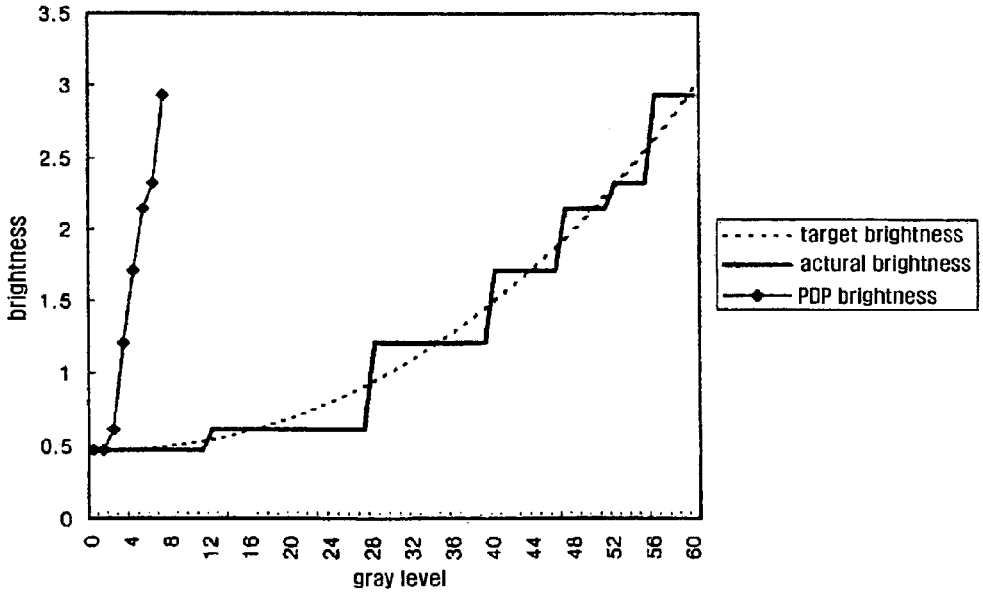
FIG. 3 is a graph showing an inverse gamma correction in the conventional plasma display apparatus.
Figure 4:
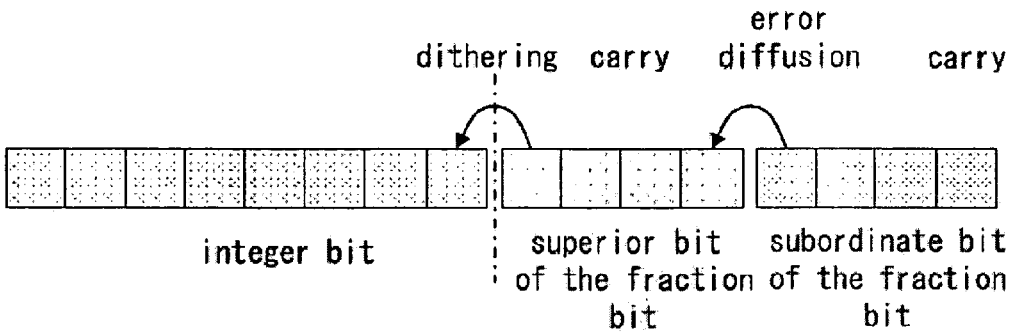
FIG. 4 is a view for illustrating the conventional method for using the error diffusion technique together with the dithering technique.
Figure 5:
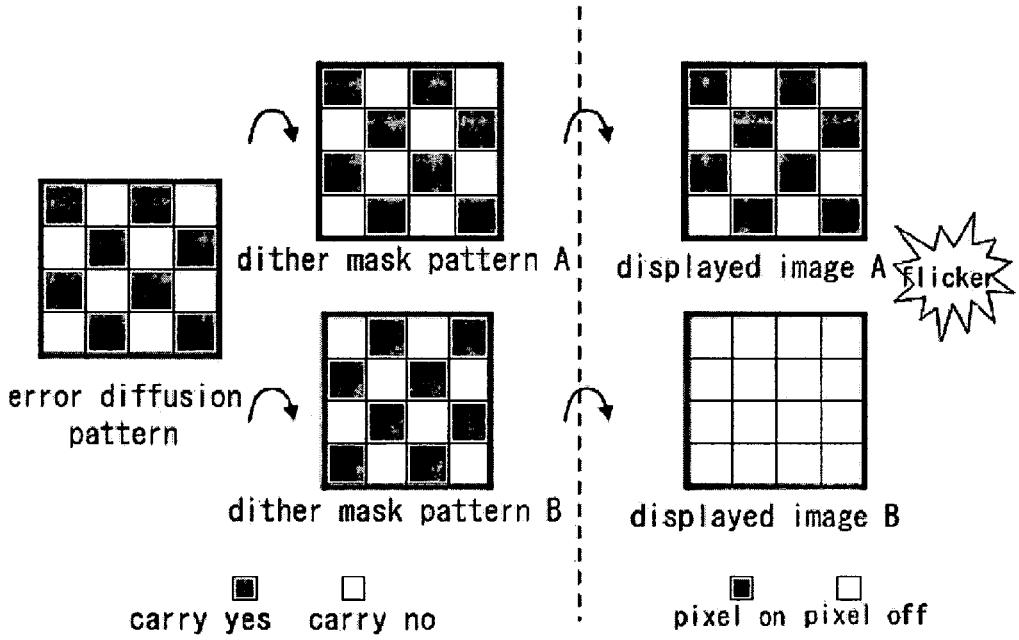
FIG. 5 is a view illustrating the problem occurred when the conventional method in which the error diffusion and the dithering are used together is applied.

Preferred embodiments of the present invention will be described in a more detailed manner with reference to the drawings.

The plasma display apparatus according to one embodiment of the present invention comprises a plasma display panel including a plurality of address electrodes; an inverse gamma correction section for inverse gamma-correcting an image signal inputted from an exterior; a halftone section for dividing a plurality of pixels adjacent to each other which a subordinate bit of a fraction bit of the image signal is allocated to into at least two or more types, performing an error diffusion among the subordinate bit of the fraction bit of the pixels corresponding to the same type, and performing a dithering of a superior bit of the fraction bit using at least two or more dither mask patterns; and a subfield mapping section for mapping the image signal which is halftone processed on the corresponding subfield.

The present invention is characterized in that at least two or more types are used in each frame in the regular order.

The present invention is characterized in that at least two or more types are used in each frame in the random order.

The present invention is characterized in that the number of the types is same as the number of the dither mask patterns.

The present invention is characterized in that the type is selected according to the dither mask patterns.

The present invention is characterized in that the pixels have the error diffusion directions which differ from each other according to the type.

The present invention is characterized in that the pixels have the error diffusion directions which differ from each other in the line unit.

The present invention is characterized in that a lookup table storage section which the error diffusion coefficient is stored in advance is further provided.

The present invention is characterized in that the error diffusion coefficients which differ from each other are assigned according to the type.

The present invention is characterized in that the error diffusion coefficient is decided according to a location of the pixel adjacent to a certain central pixel in any one type.

The present invention is characterized in that the error diffusion coefficient is decided according to a gray level value of the subordinate bit.

A method for processing an image in a plasma display apparatus according to one embodiment of the present invention comprises the steps of (a) inverse gamma-correcting an image signal inputted from an exterior; (b) dividing a plurality of pixels adjacent to each other which a subordinate bit of a fraction bit of the image signal is allocated to into at least two or more types, performing an error diffusion among the subordinate bit of the fraction bit of the pixels corresponding to the same type, and performing a dithering of a superior bit of the fraction bit using at least two or more dither mask patterns; and (c) mapping the image signal which is halftone processed on the corresponding subfield.

The present invention is characterized in that at least two or more types are used in each frame in the regular order.

The present invention is characterized in that at least two or more types are used in each frame in the random order.

The present invention is characterized in that the number of the types is same as the number of the dither mask patterns.

The present invention is characterized in that the type is selected according to the dither mask patterns.

The present invention is characterized in that the pixels have the error diffusion directions which differ from each other according to the type.

The present invention is characterized in that the pixels have the error diffusion directions which differ from each other in the line unit.

The present invention is characterized in that the step of storing the error diffusion coefficient in a lookup table in advance is further comprised.

The present invention is characterized in that the error diffusion coefficients which differ from each other are assigned according to the type.

The present invention is characterized in that the error diffusion coefficient is decided according to a location of the pixel adjacent to a certain central pixel in any one type.

The present invention is characterized in that the error diffusion coefficient is decided according to a gray level value of the subordinate bit.

Hereinafter, the concrete embodiment of the present invention will be described with reference to the accompanying drawings.

Figure 6:
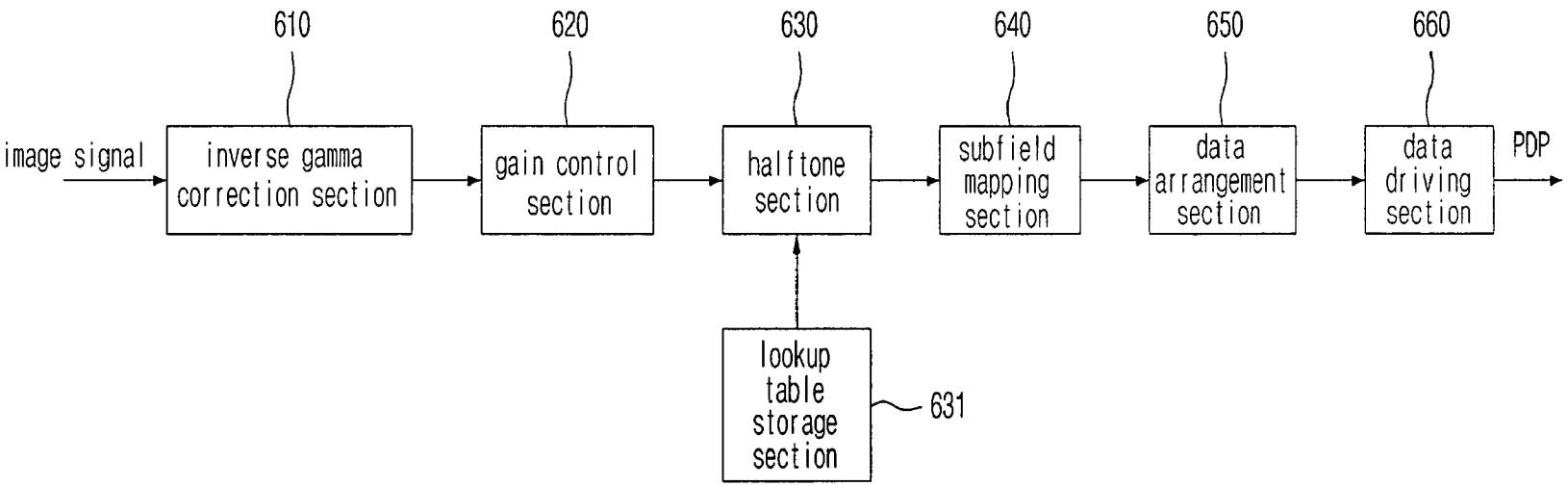
FIG. 6 is a block diagram for illustrating the plasma display apparatus according to one embodiment of the present invention.

FIG. 6 is a block diagram for illustrating the plasma display apparatus according to one embodiment of the present invention.

As shown in FIG. 6, the plasma display apparatus according to one embodiment of the present invention is provided with an inverse gamma correction section 610, a gain control section 620, a halftone section 630, a subfield mapping section 640, a data arrangement section 650 and a data driving section 660.

The inverse gamma correction section 610 inverse gamma-corrects an image signal to be inputted to convert linearly a luminance value displayed according to the gray level value of the input image signal.

The gain control section 620 multiplies the image signal of R (red), G (green) and B (blue) which is inverse gamma-corrected by the inverse gamma correction section 610 by a gain value which can be adjusted by an user or a set maker to adjust separately the gain of the image signals of R (red), G (green) and B (blue). At this time, the user or the set maker sets a color temperature to a desired value through the gain control section 620.

The halftone section 630 halftone-processes the image signal inputted from the gain control section 620, and so the luminance value displayed according to the gray level value is finely adjusted to enhance the gray level representation capability.

In the halftone section 630 according to one embodiment of the present invention, the subordinate bit of the fraction bit of the image signal which is inverse gamma-corrected divides a plurality of pixels into at least two or more types, the error diffusion is performed among the pixels corresponding to any one type, a carry generated through the error diffusion is reflected in the superior bit of the fraction bit. The superior bit reflecting the carry performs a dithering using at least two or more dither mask patterns, a carry generated through the dithering is reflected in an integer bit.

At this time, in one embodiment of the present invention, the error diffusion coefficients which differ from each other according to the error diffusion type are assigned and, in any one type, the error diffusion coefficient is decided according to a location of pixel adjacent a specific pixel as a center pixel and the gray level value of the center pixel. By storing such error diffusion coefficient in a lookup table storage section 631 in advance, the error diffusion is performed in real time when the plasma display apparatus is operated. That is, the halftone section 630 receives the error diffusion coefficient information from lookup table storage section 631 and performs the error diffusion. The error diffusion coefficient lookup table storage section 631 is provided inside or outside of the halftone section 630.

At this time, the halftone section 630 uses at least two or more types in each frame in the regular order or uses at least two or more types in each frame in random order.

Also, the halftone section 630 according to one embodiment of the present invention selects and uses any one type according to the dither mask pattern. Preferably, the number of the type is same as the number of the dither mask pattern.

Also, the halftone section 630 has different diffusion directions according to the error diffusion type or a pixel line of the plasma display panel. A detailed description on the operation characteristic of the halftone section 630 will be described below.

The subfield mapping section 640 maps the image signal inputted from the halftone section 630 in a subfield mapping table which is set in advance.

The data arrangement section 650 arranges the subfield mapping data which is inputted from the subfield mapping section 640 and arranged spatially into the data relating to the time.

The data driving section 660 receives the data relating to the time arranged by the data arrangement section 650 and supplies an address electrode (not shown) of the plasma display panel with the address driving pulse, and so the image of the plasma display panel is embodied.

FIG. 7 is a view for illustrating the error diffusion method according to one embodiment of the present invention.

In order to solve the problem that, in the convention method in which the dithering is used together with the error diffusion, the pixels in which carry are generated are not matched with each other according to the pixels, as shown in FIG. 7, in the error diffusion method according to one embodiment of the present invention, a plurality of pixels adjacent to each other are divided into at least two or more types and the error diffusion is performed between the pixels corresponding to any one type in each frame.

For example, as shown in FIG. 7, a pixel P and a pixel P' are set as a central pixel, respectively, and a plurality of pixels is divided into the A type pixels with the central pixel P as the center and the B type pixels with the central pixel P as the center. Here, the central pixels are the pixel to which the error diffusion of the adjacent pixels is transmitted.

Then, during the $N^{th}$ frame period, the error diffusion is performed by means of the A type pixels.

That is, the subordinate bit of the fraction bit assigned to the pixel 1 is multiplied by the error diffusion coefficient c1, the subordinate bit of the fraction bit assigned to the pixel 2 is multiplied by the error diffusion coefficient c2, and the subordinate bit of the fraction bit assigned to the pixel 3 is multiplied by the error diffusion coefficient c3. The error component diffused to the central pixel P is calculated by adding the values obtained by multiplying the subordinate bits of the pixels 1, 2 and 3 by the error diffusion coefficients c1, c2 and c3, respectively. Here, the error component is the value obtained by multiplying the subordinate bit by the error diffusion coefficient and then diffused to the central pixel. After the error component as described above is added to the subordinate bit of the central pixel P, the subordinate bit is reflected in the superior bit of the fraction bit depending on whether carry is generated or not. After the subordinate bit is reflected in the superior bit of the fraction bit, the error diffusion of the changed subordinate bit of the pixel P is performed again for to the A typed adjacent pixel.

Then, during the $N+1^{th}$ frame period, the error diffusion is performed by means of the A' type pixels.

That is, the subordinate bit of the fraction bit assigned to the pixel 1' is multiplied by the error diffusion coefficient c1', the subordinate bit of the fraction bit assigned to the pixel 2' is multiplied by the error diffusion coefficient c2', and the subordinate bit of the fraction bit assigned to the pixel 3' is multiplied by the error diffusion coefficient c3'. The error component diffused to the central pixel P' is calculated by adding the values obtained by multiplying the subordinate bits of the pixels 1', 2' and 3' by the error diffusion coefficients c1', c2' and c3', respectively. Here, the error component is the value obtained by multiplying the subordinate bit by the error diffusion coefficient and then diffused to the central pixel. After the error component as described above is added to the subordinate bit of the central pixel P', the subordinate bit is reflected in the superior bit of the fraction bit depending on whether carry is generated or not. After the subordinate bit is reflected in the superior bit of the fraction bit, the error diffusion of the changed subordinate bit of the pixel P' is performed again for to the A' typed adjacent pixel.

Like this, since the error diffusions corresponding to the A type pixel and the A' type pixel are performed selectively in each frame, the A type pixel and the A' type pixel have not influence on each other. With this, the each frame has the error diffusion pattern aspect which differs from those of the frames in the entire screen.

At this time, the various type pixels according to one embodiment of the present invention are used in each frame in the regular order. By using the plurality types of the pixels in each frame in the regular order, the error diffusion is performed evenly for the entire pixels.

Also, the various type pixels according to another embodiment of the present invention are used in each frame in the random order. By using the plurality types of the pixels in each frame in the random order, it is possible to prevent the error diffusion pattern from occurring regularly on the embodied image.

FIG. 8 is a view showing schematically that the error diffusion is performed on the entire screen by the error diffusion method according to one embodiment of the present invention.

In one embodiment of the present invention, as shown in FIG. 8, the pixels on the entire screen are divided into the pixels indicated by 1 and the pixels indicated by 2 and the error diffusion is performed for the pixels. That is, the error diffusion is performed among the pixels indicated by 1 in the $N^{th}$ frame, and the error diffusion is performed among the pixels indicated by 2 in the $N+1^{th}$ frame.

Here, in the conventional method, the entire pixels have same error diffusion directions, and the error diffusion patterns having the constant directivity are generated on the embodied image. Such error diffusion patterns having the constant directivity act as a factor by which the matching is impeded, taking the above fact into consideration, the error diffusions are not performed in the constant direction during one frame in one embodiment of the present invention.

That is, in one embodiment of the present invention, the unit lines have the error diffusion directions which differ from each other. For example, as shown in FIG. 8, the error diffusion is performed among the pixels selected during one frame, the error diffusion in one line is performed from the left pixel to the right pixel with respect to a horizontal direction of the screen, and the error diffusion in another line is performed from the right pixel to the left pixel. With this, a formation of the error diffusion patterns with a constant directivity is suppressed, thus it is possible to overcome the problem that the error diffusion patterns are not matched with the dither mask patterns when the dithering is performed.

In another embodiment of the present invention, the frames have the error diffusion directions which differ from each other according to the selected type. The error diffusion has the first directivity by which the error diffusion is performed from left side to right side as well as from upper side to lower side of the screen according to the selected type. Also, the error diffusion has the second directivity by which the error diffusion is performed from left side to right side as well as from lower side to upper side of the screen according to the selected type. Also, the error diffusion has the third directivity by which the error diffusion is performed from right side to left side as well as from upper side to lower side of the screen according to the selected type. In addition, the error diffusion has the fourth directivity by which the error diffusion is performed from right side to left side as well as from lower side to upper side of the screen according to the selected type. As described above, by accumulating a plurality of frames which have the error diffusion direction which differ from each other, a formation of the error diffusion patterns with a constant directivity can be suppressed. Also, taking the error diffusion directivity of the type selected during one frame, the patterns of the dither mask which can be matched with the error diffusion patterns are decided. With this, it is possible to overcome the problem that the error diffusion patterns are not matched with the dither mask patterns when the dithering is performed.

FIG. 9 is a view showing schematically a lookup table in which the error diffusion coefficient according to one embodiment of the present is stored.

As shown in FIG. 9, in one embodiment of the present invention, a plurality of lookup tables are provided, the error diffusion coefficients which differ from each other according to the type are assigned to the lookup tables. The purpose of providing the lookup tables is to optimize a matching degree of the selected error diffusion pattern and any one dither mask pattern according to the error diffusion pattern. Here, the error diffusion coefficient refers to the weights in which the error component which is decided according to a location of each pixel adjacent to the central pixel is reflected.

At this time, contrary to the conventional method in which the error diffusion coefficient is set at a constant value, in the lookup table assigned to any one type according to one embodiment of the present invention, the error diffusion coefficient is not only decided according to a location of the pixel adjacent to the specific pixel, but also the error diffusion coefficient is decided according to the gray level value of the subordinate bit assigned to the pixel located at that position. That is, a formation of the error diffusion patterns which are displayed regularly can be suppressed by deciding the error diffusion coefficient according to a location and the gray level value of the adjacent pixel in the selected type. Also, taking the matching degree of any one dither mask pattern and the pixel into consideration, the error diffusion coefficient is decided according to a location and the gray level value of the adjacent pixel so that the fine and reliable matching is achieved when the error diffusion method and the dithering method are used together.

For example, as shown in FIG. 9, two lookup tables are provided according to the A type pixels and the B type pixels of FIG. 7 and FIG. 8. The error diffusion is optimized and decided according to the locations c1, c2 and c3 of the adjacent pixels in FIG. 7 and FIG. 8 and 16 ($2^4$=16) gray level values which can be obtained when the subordinate bit is 4 bit, and then stored in the lookup table for A type. The error diffusion is optimized and decided according to the locations c1', c2' and c3' of the adjacent pixels in FIG. 7 and FIG. 8 and 16 ($2^4$=16) gray level values which can be obtained when the subordinate bit is 4 bit, and then stored in the lookup table for B type.

Figure 10:
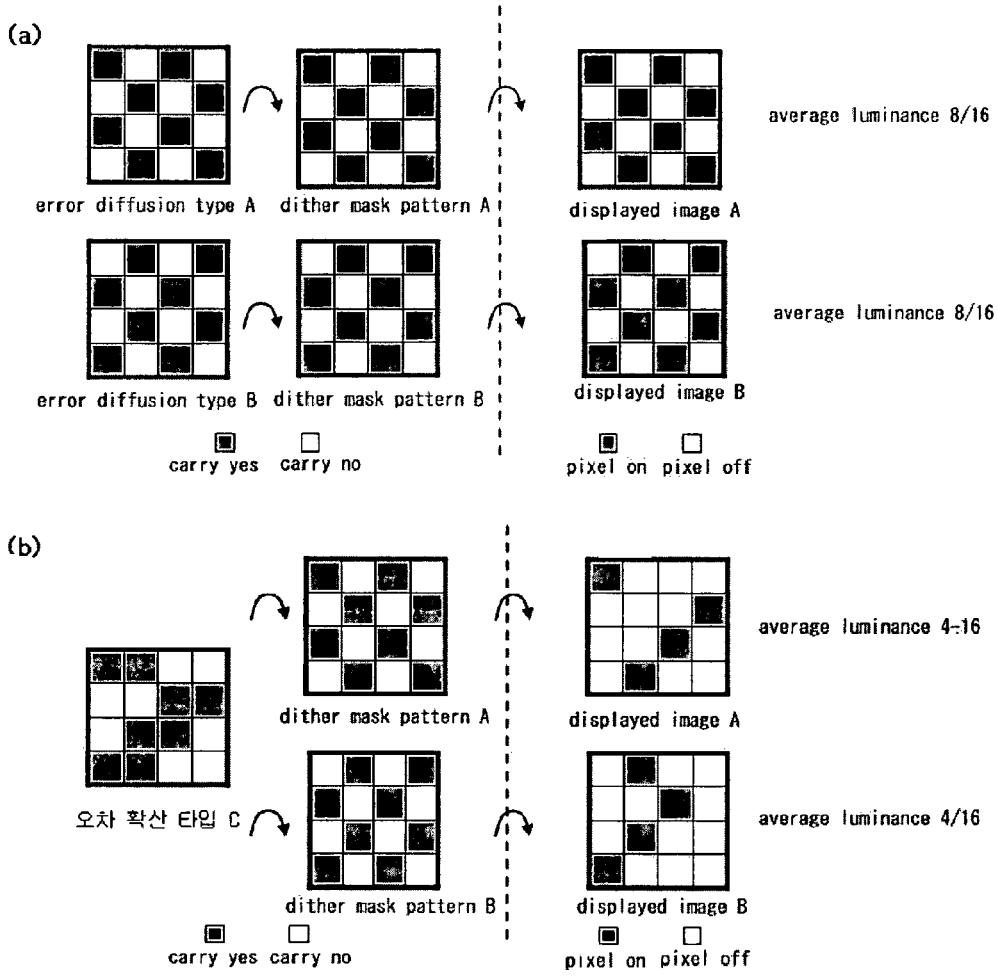
FIG. 10 is a view for illustrating the method according to one embodiment of the present in which the error diffusion is used together with the dithering.

FIG. 10 is a view for illustrating the method according to one embodiment of the present in which the error diffusion is used together with the dithering.

The error diffusion pattern and dithering patterns in FIG. 10 indicate locations of the pixels in which carry is generated, the patterns of the displayed screen indicate locations of pixels which are turned actually on/off depending on whether the carry is generated or not.

FIG. 10 (*a*) shows that the number of the error diffusion types is same as the number of the dither mask pattern matched with the error diffusion type, and any one error diffusion type which is matched optimally with the dither mask pattern is selected and used. With this, the matching problem generated in the conventional art can be solved. In addition, since the luminance is not changed rapidly, it is possible to prevent the flicker phenomenon from being generated, and the above method is applied to each of R, G, and B image signals, and so a distortion of the image is suppressed.

FIG. 10 (*b*) shows that any one error diffusion type is selected from a plurality of the error diffusion types according to at least two or more dither mask patterns and used. That is, due to the error diffusion type, the error diffusion directivity and a characteristic of the error diffusion coefficient according to one embodiment of the present invention, the error diffusion pattern which is uniformly appeared is reduced. Due to a reduction of the constant error diffusion pattern, the problem that the carry is not matched, which is extremely appeared in a conventional apparatus, is solved. In one embodiment of the present invention, accordingly, it is possible to use one error diffusion type together with at least two or more dither mask patterns. Two frames shown in FIG. 10 are displayed with the same luminance value. With this, the flicker phenomenon is prevented and a distortion of the image is suppressed, and so the gray level representation capability of the displayed image is enhance.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus, comprising a plasma display panel including a plurality of address electrodes;

an inverse gamma correction section for inverse gamma-correcting an image signal inputted from an exterior;

a halftone section for dividing a plurality of pixels adjacent to each other, which a subordinate bit of a fraction bit of the inverse gamma corrected image signal by the inverse gamma correction section is allocated to, into at least two or more types, performing an error diffusion among the subordinate bit of the fraction bit of the pixels corresponding to the pixels of one type (A error diffusion type) in each frame, and using different type (B error diffusion type) of pixels consecutively in a plurality of consecutive frames, and performing a dithering of a superior bit of the fraction bit using two types of dither mask patterns; and a subfield mapping section for mapping the image signal which is halftone processed on the corresponding subfield, wherein the A error diffusion type matches one type of the dither mask patterns and the B error diffusion type matches the other type of the dither mask patterns.

2. The plasma display apparatus as claimed in claim 1, wherein the error diffusion is performed by the at least two or more types are used in each frame in the regular order.

3. The plasma display apparatus as claimed in claim 1, wherein the error diffusion is performed by the at least two or more types are used in each frame in the random order.

4. The plasma display apparatus as claimed in claim 1, wherein the number of the types is same as the number of the dither mask patterns.

5. The plasma display apparatus as claimed in claim 4, wherein an error diffusion type is selected according to the dither mask patterns.

6. The plasma display apparatus as claimed in claim 1, wherein an error diffusion type is selected according to the dither mask patterns.

7. The plasma display apparatus as claimed in claim 1, wherein the pixels have the error diffusion directions which differ from each other.

8. The plasma display apparatus as claimed in claim 1, wherein the error diffusion in one line is performed from the left pixel to the right pixel with respect to a horizontal direction of the screen, and the error diffusion in another line is performed from the right pixel to the left pixel.

9. The plasma display apparatus as claimed in claim 1, further comprises a lookup table storage section in which the error diffusion coefficient is stored in advance.

10. The plasma display apparatus as claimed in claim 9, wherein the error diffusion coefficients which differ from each other are assigned according to the type.

11. The plasma display apparatus as claimed in claim 9, wherein the error diffusion coefficient is decided according to a location of the pixel adjacent to a certain central pixel in any one type.

12. The plasma display apparatus as claimed in claim 9, wherein the error diffusion coefficient is decided according to a gray level value of the subordinate bit.

13. The plasma display apparatus as claimed in claim 1, wherein the error diffusion coefficients which differ from each other are assigned according to the type.

14. The plasma display apparatus as claimed in claim 1, wherein the error diffusion coefficient is decided according to a location of the pixel adjacent to a certain central pixel in any one type.

15. The plasma display apparatus as claimed in claim 1, wherein the error diffusion coefficient is decided according to a gray level value of the subordinate bit.

16. A method for processing an image in a plasma display apparatus, comprising the steps of (a) inverse gamma-correcting an image signal inputted from an exterior;

(b) dividing a plurality of pixels adjacent to each other, which a subordinate bit of a fraction bit of the inverse gamma corrected image signal by the inverse gamma correction section is allocated to, into at least two or more types, performing an error diffusion among the subordinate bit of the fraction bit of the pixels corresponding to the pixels of one type (A error diffusion type) in each frame, and using different type (B error diffusion type) of pixels consecutively in a plurality of consecutive frames, and performing a dithering of a superior bit of the fraction bit using at least two or more dither mask patterns; and (c) mapping the image signal which is halftone processed on the corresponding subfield, wherein the A error diffusion type matches one type of the dither mask patterns, the B error diffusion type matches the other type of the dither mask patterns.

17. The method for processing the image in the plasma display apparatus as claimed in claim 16, wherein the error diffusion is performed by the at least two or more types in each frame in the regular order.

18. The method for processing the image in the plasma display apparatus as claimed in claim 16, wherein the error diffusion is performed by the at least two or more types in each frame in the random order.

19. The method for processing the image in the plasma display apparatus as claimed in claim 16, wherein the number of the types is same as the number of the dither mask patterns.

20. The method for processing the image in the plasma display apparatus as claimed in claim 19, wherein an error diffusion type is selected according to the dither mask patterns.

21. The method for processing the image in the plasma display apparatus as claimed in claim 16, wherein an error diffusion type is selected according to the dither mask patterns.

22. The method for processing the image in the plasma display apparatus as claimed in claim 16, wherein the pixels have the error diffusion directions which differ from each other.

23. The method for processing the image in the plasma display apparatus as claimed in claim 16, wherein the error diffusion in one line is performed from the left pixel to the right pixel with respect to a horizontal direction of the screen, and the error diffusion in another line is performed from the right pixel to the left pixel.

24. The method for processing the image in the plasma display apparatus as claimed in claim 16, further comprising the step of storing the error diffusion coefficient in a lookup table in advance.

25. The method for processing the image in the plasma display apparatus as claimed in claim 24, wherein the error diffusion coefficients which differ from each other are assigned according to the type.

26. The method for processing the image in the plasma display apparatus as claimed in claim 24, wherein the error diffusion coefficient is decided according to a location of the pixel adjacent to a certain central pixel in any one type.

27. The method for processing the image in the plasma display apparatus as claimed in claim 24, wherein the error diffusion coefficient is decided according to a gray level value of the subordinate bit.

28. The method for processing the image in the plasma display apparatus as claimed in claim 16, wherein the error diffusion coefficients which differ from each other are assigned according to the type.

29. The method for processing the image in the plasma display apparatus as claimed in claim 16, wherein the error diffusion coefficient is decided according to a location of the pixel adjacent to a certain central pixel in any one type.

30. The method for processing the image in the plasma display apparatus as claimed in claim 16, wherein the error diffusion coefficient is decided according to a gray level value of the subordinate bit.

* * * * *